US006511001B1

(12) United States Patent
Huang

(10) Patent No.: US 6,511,001 B1
(45) Date of Patent: Jan. 28, 2003

(54) HAND-HELD WATER NOZZLE FOR GARDENING OR WASHING

(76) Inventor: Dustin Huang, No. 2, Yung-Feng Lane, Hsin-Pao Village, Fang-Yuan Hsiang Chang Hua Hsien (TW)

( * ) Notice: Subject to any disclaimer, the term of this patent is extended or adjusted under 35 U.S.C. 154(b) by 0 days.

(21) Appl. No.: 10/159,937

(22) Filed: Jun. 3, 2002

(51) Int. Cl.[7] ..... B05B 7/02

(52) U.S. Cl. ..... 239/526; 239/587.6; 239/587.1; 285/123; 285/185; 285/272

(58) Field of Search ..... 239/525, 526, 239/587.1, 587.5, 587.6, 588, 532, 289, 140; 285/184, 185, 123, 168, 273, 275, 279, 272

(56) References Cited

U.S. PATENT DOCUMENTS 2,857,201 A * 10/1958 Palmer ..... 239/587.5
3,940,072 A * 2/1976 Ishikawa et al. ..... 239/587.1
5,372,389 A * 12/1994 Tam et al. ..... 285/123
6,257,505 B1 * 7/2001 Wang ..... 239/526
6,264,121 B1 * 7/2001 McClary ..... 239/525

* cited by examiner

*Primary Examiner*—Michael Mar
*Assistant Examiner*—Dinh Q. Nguyen
(74) *Attorney, Agent, or Firm*—Harrison & Egbert

(57) ABSTRACT

A hand-held water nozzle includes a handle and a nozzle head fastened to a head mount which is rotatably fastened to a seat in conjunction with a slide block. The seat is fastened fixedly to the handle. The head mount is provided with a toothed portion. The slide block is provided with a toothed portion. The toothed portions of the head mount and the slide block are engaged with each other, thereby enabling the nozzle head to be angularly adjusted in a series of steps.

3 Claims, 5 Drawing Sheets

HAND-HELD WATER NOZZLE FOR GARDENING OR WASHING

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a water nozzle, and more particularly to a hand-held water nozzle for use in gardening or washing.

BACKGROUND OF THE INVENTION

The conventional hand-held water nozzle comprises a handle and a nozzle head fastened fixedly at an angle to one end of the handle. In view of the fact that the nozzle head cannot be angularly adjusted, the conventional hand-held water nozzle lacks operational flexibility. Such a handicap is responsible for poor reception of the conventional hand-held water nozzle by the consumer.

BRIEF SUMMARY OF THE INVENTION

The primary objective of the present invention is to provide a hand-held water nozzle with a nozzle head which is angularly adjustable in a series of steps.

In keeping with the principle of the present invention, the foregoing objective of the present invention is attained by the handheld water nozzle comprising a main body, and a nozzle head. The main body is provided at one end with a seat. The nozzle head is mounted on a head mount, which is pivotally fastened with the seat in conjunction with a slide block and a spring. The slide block is provided with a toothed end and is pivoted with the seat such that the toothed end of the slide block is engaged with a toothed end of a fastening hole of the head mount, thereby enabling the nozzle head to be angularly adjusted in a series of steps.

The features and the advantages of the present invention will be more readily understood upon a thoughtful deliberation of the following detailed description of the present invention with reference to the accompanying drawings.

DETAILED DESCRIPTION OF THE INVENTION

Figure 1:
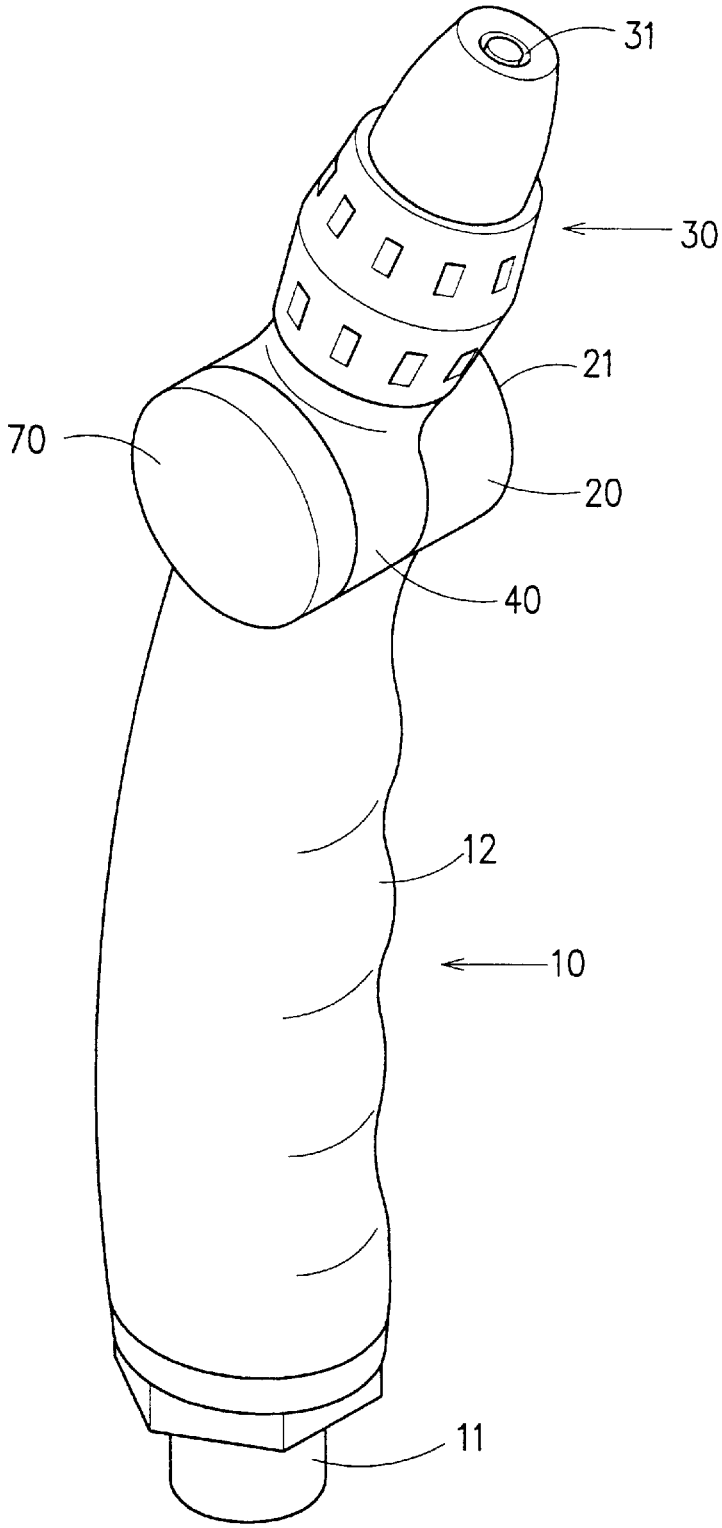
FIG. 1 shows a perspective view of the present invention.
Figure 2:
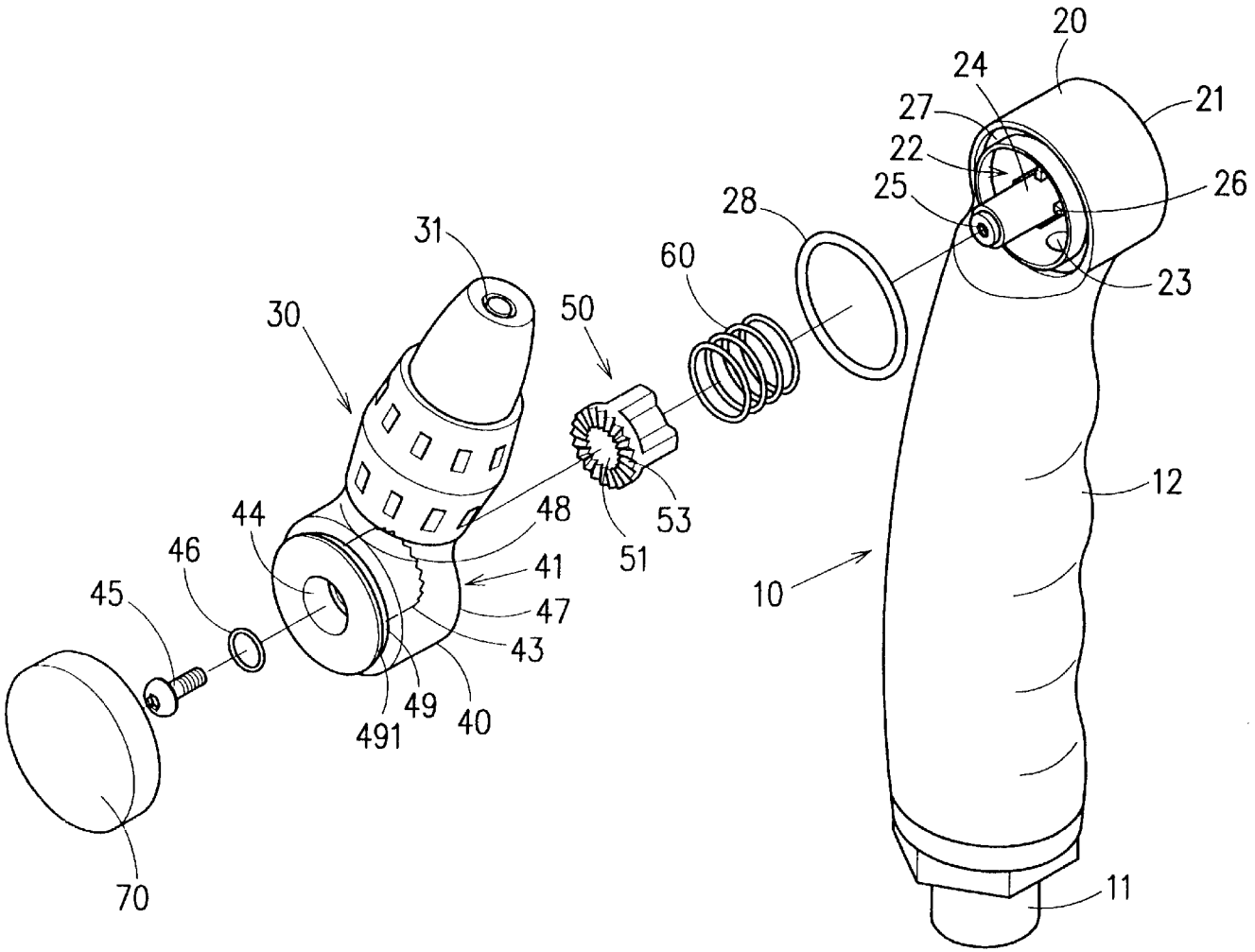
FIG. 2 shows an exploded perspective view of the present invention.

As shown in FIGS. 1–4, a hand-held water nozzle embodied in the present invention comprises a main body 10, and a nozzle head 30.

The main body 10 is formed of a handle 12, a hose connector 11 fastened at one end of the handle 12, and a seat 20 fastened at other end of the handle 12. The seat 20 is of a tubular construction and is provided with a closed end 21 and an open end 22 opposite to the closed end 21.

The seat 20 is provided in the side wall with a water admitting hole 23 in communication with a water channel 13 of the handle 12. The water channel 13 is in turn in communication with the hose connector 11. The seat 20 is provided in the hollow interior with a fastening pillar 24 extending form the inner wall of the closed end 21 toward the open end 22. The fastening pillar 24 is provided in the free end with a threaded hole 25, and in the outer wall with a plurality of retaining ribs 26. The open end 22 is provided in the inner wall with an annular groove 27 and a washer 28 located in the annular groove 27.

The nozzle head 30 is provided at the outer end with a water discharging hole 31 and is mounted at the inner end on a head mount 40, which is provided in the interior with a water slot 41 in communication with the water discharging hole 31 of the nozzle head 30 via a through hole 42 of the top wall of the water slot 41. The water slot 41 is provided in the center with a tubular projection 43 having an axial through hole 44. The head mount 40 is rotatably mounted on the fastening pillar 24 of the seat 20 in conjunction with a slide block 50, and a spring 60 which is fitted over the fastening pillar 24 such that an inner end of the spring 60 urges the inner wall of the closed end 21 of the seat 20, and that an outer end of the spring 60 urges an inner end of the slide block 50. The slide block 50 is provided with an axial through hole 51 which is in turn provided in the inner wall with a plurality of retaining slots 52. The slide block 50 is mounted on the fastening pillar 24 of the seat 20 such that the retaining ribs 26 of the fastening pillar 24 are retained in the retaining slots 52 of the slide block 50. The slide block 50 is provided in an outer end with a toothed portion 53 which is engaged with a toothed portion 48 of the tubular projection 43. The head mount 40 is fastened with the fastening pillar 24 of the seat 20 by a fastening bolt 45 which is engaged with the threaded hole 25 of the fastening pillar 24 via the axial through hole 44 of the tubular projection 43. Located between the fastening bolt 45 and the fastening pillar 24 is a washer 46. The inner end edge 47 of the head mount 40 comes in close contact with the washer 28 which is located in the annular groove 27 of the open end 22 of the seat 20. The inner end of the tubular projection 43 is provided with a toothed portion 48, which is engaged with the toothed portion 53 of the slide block 50. The head mount 40 is provided with an outer end edge 49 with a flange 491.

The head mount 40 is optionally provided at the outer end edge 49 with a cover 70 which is provided in an inner open end with a retaining groove 71 in which the flange 491 of the outer end edge 49 of the head mount 40 is received.

The nozzle head 30 is angularly adjusted by turning the head mount 40 on the fastening pillar 24 serving as a pivot. In light of the toothed portion 48 of the tubular projection 43 of the head mount 40 is engaged with the toothed portion 53 of the slide block 50, the nozzle head 30 can be angularly adjusted in a series of steps.

Figure 3:
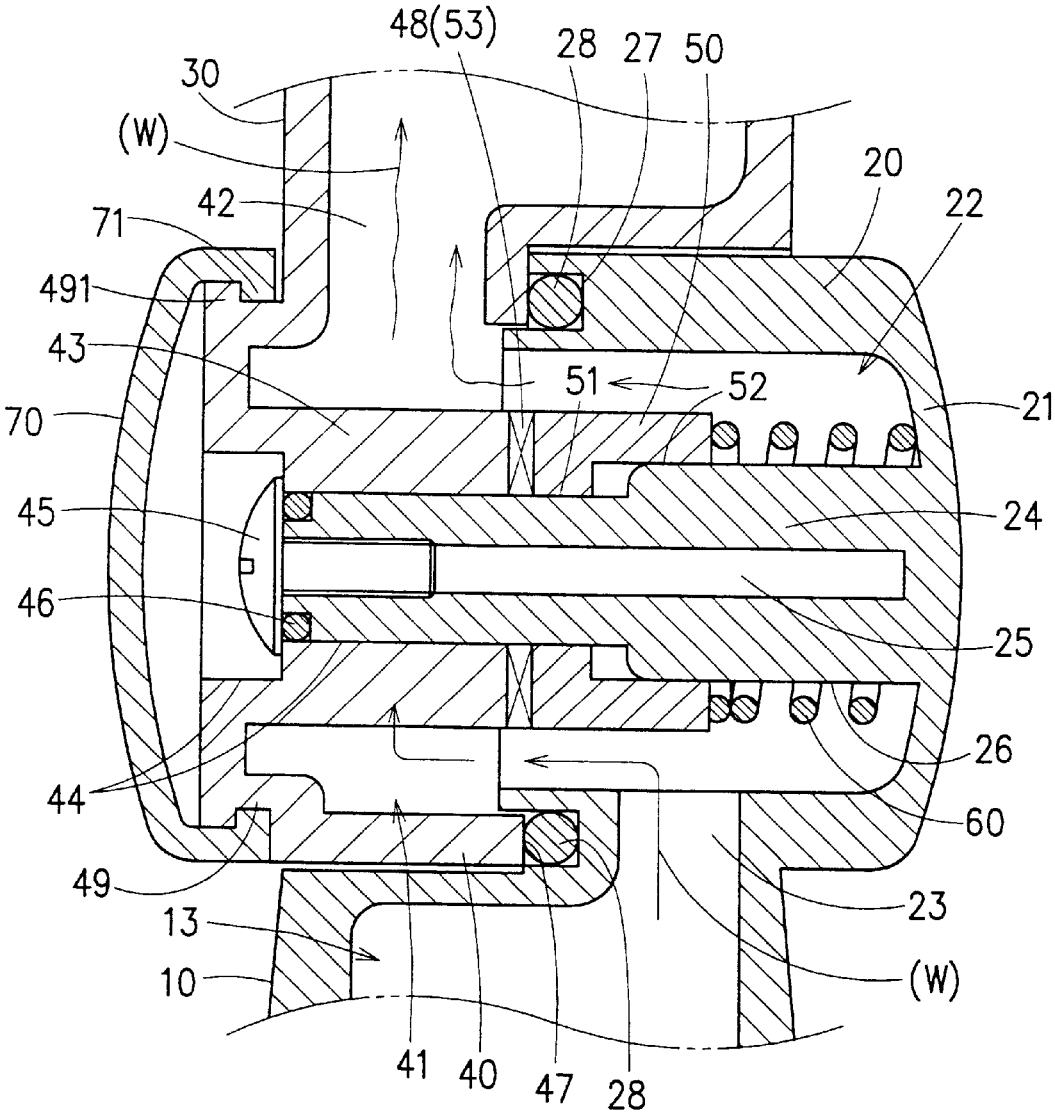
FIG. 3 shows a partial sectional view of the present invention in action.
Figure 4:
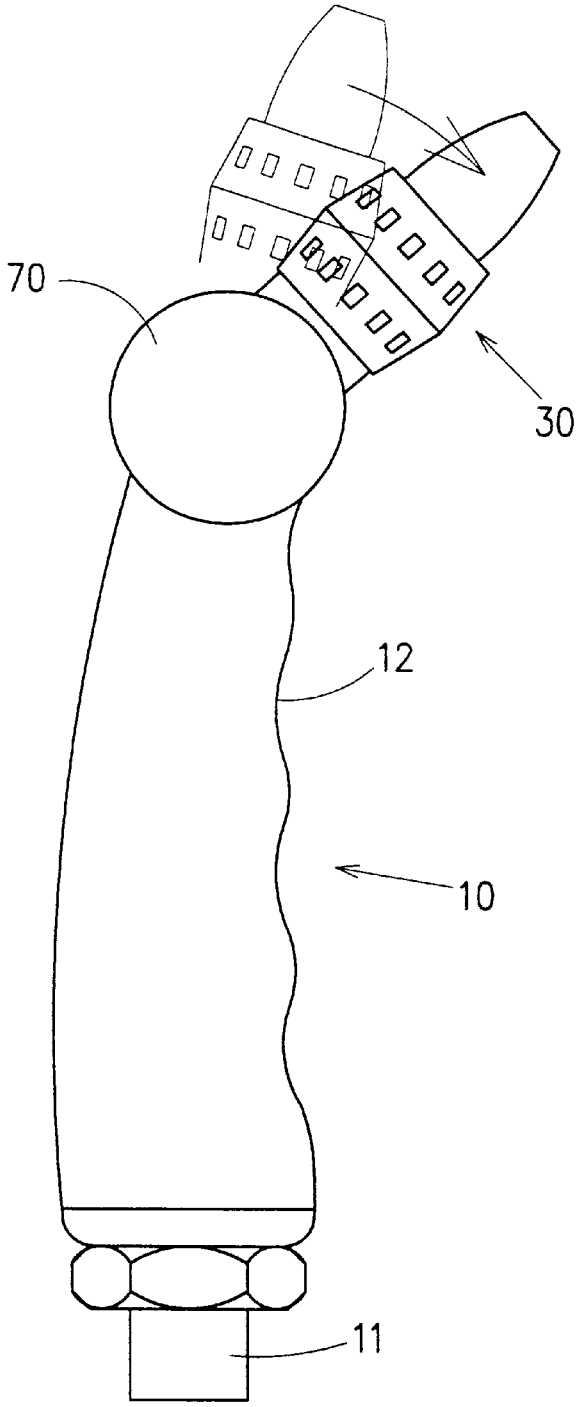
FIG. 4 shows a schematic view of angular adjustment of the nozzle head of the present invention.

As shown in FIG. 3, water (W) is emitted from the water discharging hole 31 of the nozzle head 30 via the through hole 42 of the water slot 41 of the head mount 40, the open end 22 of the seat 20, the water admitting hole 23 of the seat 20, and the water channel 13 of the handle 12.

Figure 5:
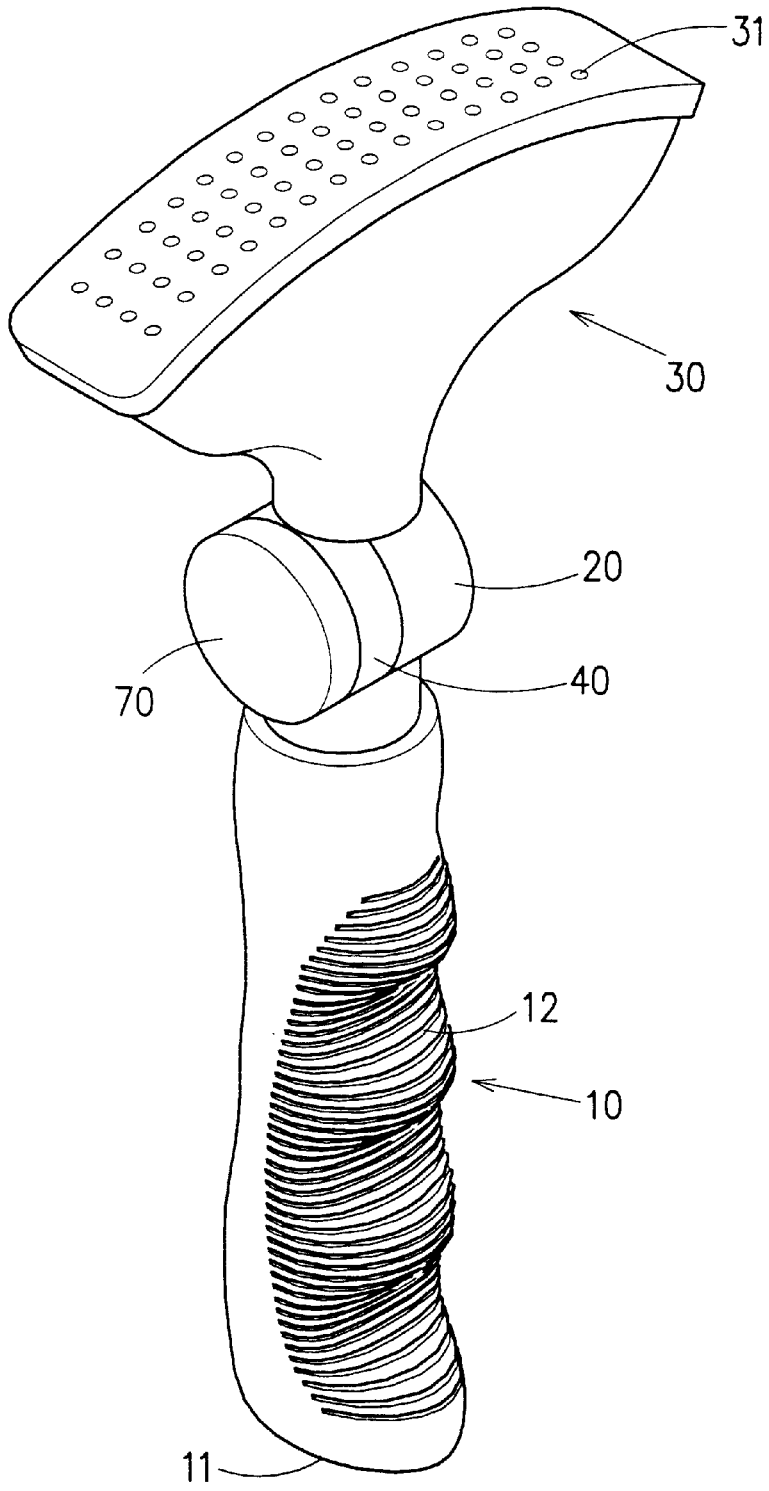
FIG. 5 shows a perspective view of another preferred embodiment of the present invention.

As shown in FIG. 5, the nozzle head 30 of the present invention is provided with a number of water discharging holes 31 to emit water in fine streams.

I claim:

1. A hand-held water nozzle comprising:

a handle comprising, in an interior, a water channel, and, at one end thereof, a hose connector fastened thereto such that the hose connector is aligned with said water channel, said handle provided at another end with a tubular seat fastened thereto, said tubular seat provided in the side wall of a hollow interior with a water admitting hole in communication with said water channel of said handle, said seat comprised of a closed end and an open end opposite to said closed end, said seat further provided in the hollow interior with a fastening pillar extending toward said open end from an inner wall of said closed end such that said fastening pillar is comprised of, in a free end, a threaded hole, and, in an outer wall, a plurality of retaining ribs;

a spring fitted over said fastening pillar such that an inner end of said spring urges the inner wall of said closed end of said seat;

a slide block comprised of an axial through hole which is in turn provided in an inner wall with a plurality of retaining slots, said slide block being mounted on said fastening pillar of said seat such that said retaining ribs are received in said retaining slots, and that an inner end of said slide block is urged by an outer end of said spring, said slide block further provided at an outer end with a toothed portion;

a head mount provided in an interior with a water slot which is comprised of, in a top wall, a through hole and, in a center, a tubular projection comprising an axial through hole and a toothed portion located at an inner end thereof whereby said head mount is rotatably mounted on said fastening pillar of said seat such that said axial through hole of said tubular projection is fitted over said fastening pillar, and that said toothed portion of the inner end of said tubular projection is engaged with said toothed portion of said slide block, and further that said head mount is fastened to said fastening pillar of said seat by a fastening bolt which is engaged with said threaded hole of the free end of said fastening pillar via said axial through hole of said tubular projection and said axial through hole of said slide block; and a nozzle head provided at one end with at least one water discharging hole and fastened at another end to said head mount such that said water discharging hole is in communication with said through hole of the top wall of said water slot of said head mount whereby said nozzle head is turned along with said head mount at the time when said head mount is turned on said fastening pillar serving as a pivot, with said nozzle head being turned in relation to said seat in a series of steps by virtue of the engagement of said toothed portions of said slide block and said tubular projection of said head mount.

2. The hand-held water nozzle as defined in claim 1, wherein said head mount is comprised of an inner end edge; wherein said seat is comprised of, at an open end, an annular groove, and a washer located in said annular groove such that said washer is in an intimate contact with said inner end edge of said head mount.

3. The hand-held water nozzle as defined in claim 1, wherein said head mount is comprised of an outer end edge having a flange, said head mount further comprised of a cover whereby said cover is provided in an open end with a retaining groove and is joined with said outer end edge such that said retaining groove retains said flange of said outer end edge of said head mount.

* * * * *